US009187794B2

(12) United States Patent
Brenner et al.

(10) Patent No.: US 9,187,794 B2
(45) Date of Patent: Nov. 17, 2015

(54) PROCESS AND APPARATUS FOR HARDENING THE SURFACE LAYER OF COMPONENTS HAVING A COMPLICATED SHAPE

(75) Inventors: Berndt Brenner, Dresden (DE); Steffen Bonss, Zella-Mehlis (DE); Frank Tietz, Dresden (DE); Marko Seifert, Dresden (DE); Jan Hannweber, Dresden (DE); Stefan Kuehn, Amtsberg (DE); Udo Karsunke, Rosswein (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 1236 days.

(21) Appl. No.: 12/312,115
(22) PCT Filed: Oct. 10, 2007
(86) PCT No.: PCT/EP2007/008787

§ 371 (c)(1),
(2), (4) Date: Feb. 1, 2010
(87) PCT Pub. No.: WO2008/049513

PCT Pub. Date: May 2, 2008
(65) Prior Publication Data

US 2010/0126642 A1 May 27, 2010
(30) Foreign Application Priority Data

Oct. 27, 2006 (DE) ..... 10 2006 050 799
(51) Int. Cl.
*C21D 1/42* (2006.01)
*C21D 1/09* (2006.01)
(Continued)

(52) U.S. Cl.
CPC *C21D 1/09* (2013.01); *C21D 10/00* (2013.01); *C21D 10/005* (2013.01); *C21D 11/00* (2013.01)
(58) Field of Classification Search
CPC ..... C21D 1/09; C21D 11/00; C21D 10/005; C21D 10/00
USPC ..... 148/567, 566; 219/660, 566, 66
See application file for complete search history.

(56) References Cited

U.S. PATENT DOCUMENTS 4,200,603 A * 4/1980 Raffel et al. ..... 264/51
4,270,397 A * 6/1981 Adams ..... 74/89.18
(Continued)

FOREIGN PATENT DOCUMENTS

EP 1 029 932 A1 8/2000

OTHER PUBLICATIONS

Miokovic et al., "Prediction of phase transformations during laser surface hardening of AISI 4140 including the effects of inhomogeneous austeniteformation", Materials Science & Engineeringa: Structural Materials: Properties, Microstructure & Processing, Lausanne, CH, Bd. 435-436, (Nov. 5, 2006), pp. 547-555.
(Continued)

*Primary Examiner* — Rebecca Lee
(74) *Attorney, Agent, or Firm* — Jacobson Holman, PLLC.

(57) ABSTRACT

The invention relates to the hardening of the surface layer of parts of machines, plants and apparatuses and also tools. Objects for which the application is possible and advantageous are components which are subjected to severe fatigue or wear stresses and are composed of hardenable steels and have a complicated shape and whose surface has to be hardened selectively on the functional surfaces or whose functional surface has a multidimensional shape. The process for hardening the surface layer of components having a complicated shape is carried out by means of a plurality of energy input zones. According to the invention, it is characterized in that the energy input zones are conducted on different curved parts separately in space and time and by means of cooperatively working transport systems so that superposition of the individual temperature fields forms a uniform temperature field which completely covers the functional surface of the component and within which each surface element of the later hardening zone of the component attains the selected austenite formation temperature interval $\Delta T_a$ at least once and the time interval $\Delta t$ between the maximum temperatures $T_{maxn}$ of the individual temperature fields is from 3.1 to 3.n smaller than the time $\Delta t_{mS}$ which is required to go below the martensite start temperature MS during the cooling phase. The apparatus by means of which the process of the invention can be carried out is, according to the invention, characterized in that the energy configuring units are connected to one or more energy sources for optical or electromagnetic radiation and are each fixed to separate but cooperatively operating transport systems.

7 Claims, 7 Drawing Sheets

(51) Int. Cl.

| | |
|---|---|
| ***C21D 10/00*** | (2006.01) |
| ***C21D 11/00*** | (2006.01) |
| *C21D 1/34* | (2006.01) |
| *C21D 9/00* | (2006.01) |

(56) References Cited

U.S. PATENT DOCUMENTS

| | | | | |
|---|---|---|---|---|
| 4,533,400 | A | 8/1985 | Benedict | |
| 4,644,127 | A * | 2/1987 | La Rocca | 219/121.84 |
| 5,366,345 | A | 11/1994 | Gerdes et al. | |
| RE38,936 | E * | 1/2006 | Nakamura et al. | 310/90 |
| 2002/0074066 | A1 | 6/2002 | Brenner et al. | |
| 2004/0060623 | A1 | 4/2004 | Boke et al. | |
| 2006/0213588 | A1 * | 9/2006 | Fujita et al. | 148/511 |

OTHER PUBLICATIONS

Zubchenko et al., "Design of processes of austenization and structure formation in surface hardening of forming rolls conducted with the use of power current inductors", Metal Science & Heat Treatment, Kluwer Academic Publishers-Plenum Publishers, NE, Bd. 48, Nr. 7-8, (Jul. 1, 2006) pp. 317-322.

Seifert et al., "Pioneering laser scanning system for hardening of turbine blades", Conference Proceedings—International Congress on Applications of Laser and Electro-Optics, vol. 87f, pp. 1-10, (1999).

Botts, M., "Lighter Automobiles Through Laser Beam Welding", Informationsdienst Wissenschaft, Sep. 28, 2006.

* cited by examiner a.
Section A-A
b.
c.
29.1
17.1
21.1
2.1
22.1
2.2
21.2
22.2
17.2
29.2
1
8
21
27
A
A
28
24.1
19.1
24.2
19.2
b1
t1
b2 a.
27
8
21.1
21.2
A
B
C
8
1
b.
Section A-A
29.1
17.1
27
29.2
17.2
β
α
16.1
24.1
24.2
16.2
1
c.
Section B-B
29.1
27
29.2
17.2
β
α
17.1
16.1
24.1
16.2
24.2
1
d.
Section C-C
29.1
27
29.2
17.2
β
α
17.1
16.1
24.1
16.2
24.2
1

PROCESS AND APPARATUS FOR HARDENING THE SURFACE LAYER OF COMPONENTS HAVING A COMPLICATED SHAPE

This is a National Stage of PCT/EP07/008787 filed Oct. 10, 2007 and published in German, which has a priority of German No. 10 2006 050 799.1 filed Oct. 27, 2006, hereby incorporated by reference.

BACKGROUND

The invention pertains to boundary hardening of machine, equipment and apparatus parts, as well as tools. Objects in which its application is possible and expedient are components made of hardenable steels that are exposed to severe fatigue or wear, have a complicated shape, and whose surface must be selectively hardened on the functional surfaces, or in which the functional surface has a multidimensional shape. The invention is particularly advantageous for use in those components, in which the geometry of the functional surface changes three-dimensionally along the component. Such components include large dies, cutting and trimming tools, as well as compression molds for auto body production, turbine blades for the low-pressure part of steam turbines, cam disks, machine beds of tools, etc. Other applications are local heat treatments, like boundary solution annealing, boundary tempering or quenching of geometrically complicated components.

PRIOR ART

Boundary hardening is a common method in engineering to increase wear resistance and fatigue strength of components made of hardenable steels. Flame, inductive energy, electron and laser beams are used as energy sources—listed according to increasing power density and 3-D capability.

The functional surface being hardened often includes two surfaces abutting each other at a certain angle, for example, in cutting tools or shaping dies. In such cases both surfaces must optimally be hardened simultaneously, in order to prevent so-called annealing zones. The annealing zones form by repeated temperature exposure up to the level of the beginning of the austenite conversion of the previously produced hardening track from the temperature field of the subsequent track. This results in short-term annealing of the areas of the previously produced track to an extent that the wear resistance and fatigue strength drastically deteriorate in a number of load situations.

To avoid these annealing zones, in the case of induction hardening, correspondingly shaped inductors, so-called two-surface inductors, are used, which correspond in their contour roughly to the negative of the geometry of the surfaces abutting each other. A multipart segmented inductor is also known for flat 2-D components (see M. Botts "Lighter Automobiles by Laser Welding", in: Information Service Science [*Informationsdienst Wissenschaft*], Sep. 28, 2006), which permits generation of curved tracks of annealing zones on two-dimensional components. In principle, curved hardening tracks would also be possible in flat components. The inductor is guided mechanically over the component here by means of a die.

In the case of laser hardening, beam splitter units are known, which, in their variant with the greatest flexibility, are equipped with two laser beam scanner systems (see M. Seifert, B. Brenner, F. Tietz, E. Beyer: "Pioneering laser scanning system for hardening of turbine blades" in: Conference proceedings "International Congress on Applications of Laser and Electro-Optics", San Diego, Calif., USA, Nov. 15-18, 1999, Vol. 87f, pages 1-10). In particular, the system consists of a beam splitter optics for the laser beam of a $CO_2$ laser, two parabolically curved focusing mirrors and two laser scanning systems arranged in the beam path. By shifting the position of the beam splitter mirror, the distances between the beam splitter mirror, focusing mirror, scanning mirror and the variation of scanning angle can be adjusted beforehand, both to the beam angle of incidence and the beam dimensions (width, length). Components with two functional surfaces abutting each other under angle $\alpha$ can be hardened simultaneously in the angle range of about 10°.$\alpha$.80° without producing annealing zones.

The deficiency, both in the arrangement for induction hardening by means of a two-surface shaped inductor or multipart segmented inductor and in the arrangement for laser hardening with beam splitters and adjustable beam forming systems, lies in the fact that components, in which the angle $\alpha$ or the shape of the surface being hardened changes along the abutting edge of the two functional surfaces, cannot be hardened with them. Turbine blades that are to be hardened in the area of their inlet edge or cutting tools, whose cutting edge has a 3-D-curved trend, should be mentioned prototypically as an embodiment of such components. The reason for this is that in both cases the geometry of the energy-forming unit and therefore the power density distribution on the two functional surfaces cannot be adjusted during machining.

SUMMARY OF THE INVENTION

The objective of the invention is to provide a new and flexible method and a corresponding apparatus that also permits hardening of functional surfaces of components with complicated shape according to stress and without the occurrence of annealing zones. In particular, it should also be suitable for boundary hardening of components, in which the abutting edge between two adjacent functional surfaces has a three-dimensional trend and/or the angle $\alpha$ between adjacent functional surfaces changes along their abutting edges.

The underlying task of the invention is to provide a method and apparatus that permits a desired temperature field to be adjusted flexibly, so that it can be adjusted during machining along multidimesionally curved abutting edges of the functional surfaces to the local heat removal conditions and local wear and load conditions, as well as geometric changes.

To generate a homogeneous boundary layer hardened without annealing zones that extends over the entire functional surface, several energy effect zones, or input zones, generated by appropriate energy-forming units, are guided over the functional surface on different path curves separated spatially and in time. This occurs according to the invention through several cooperating movement or transport systems. Robots, CNC-, NC-, mechanically or hydraulically controlled installations or combinations of these can be used as movement systems. The individual path curves that are traveled by the individual movement systems are laid out, so that the temperature fields generated by the individual energy effect zones overlap, so that the overlapping individual temperature fields form a union temperature field. Each surface element in the zone being hardened reaches the selected austenitization temperature interval $\Delta T_a$ at least once. According to the invention, this need not occur simultaneously for the individual energy effect zones, but within a time interval $\Delta t_{ms}$ for reaching the corresponding maximum temperature $T_{max\ n}$ of adjacent energy effect zones, which is smaller than the time, within which the areas of the previously produced individual temperature fields are cooled to the martensite start temperature.

Since both the heat removal conditions and the requirements on hardening depth and width of the entire hardening zone can vary in components of complicated shape and functional zones from location to location, the power density distributions of the individual energy effect zones are not constant, but are chosen during the hardening process according to the local requirements of desired hardening widths and depths.

Achievement of the required uniform austenitization temperature interval $\Delta T_a$ over the entire width of the hardening zone requires appropriately controllable energy sources of sufficiently high power density and adjustable power density distribution within the individual energy effect zones, in addition to appropriate spatial and temporal overlapping of the individual temperature fields. It is therefore advantageous, to use laser radiation or inductive fields as energy sources.

A particularly flexible and readily controllable possibility for location-dependent adjustment of the power density distributions represents oscillation of appropriately partially defocused laser beams when using laser beams as the energy source. The oscillation functions can then be varied as a function of location and are driven or generated by the controls of the movement systems. This type of control of power density distributions especially includes the possibility of setting asymmetric power density distributions by using non-harmonic oscillation functions across the advance direction of the energy effect zone. This is particularly advantageous, if the functional surface extends along edges or cuts.

If the heat energy is generated by an inductive energy field, adjustment of the power density distributions can occur by simultaneous use of several differently shaped inductors, in which their coupling distance to the component and/or their mutual spacing or their mutual overlapping are adjusted as a function of location. This can be achieved simply and advantageously by running different movement programs for the individual inductors.

For the hardening of components with large functional surfaces of complex shape, it is possible to generate in the same hardening process the uniform temperature field by simultaneous action both of laser and inductive energy. This variant of using different energy sources is particularly advantageous for applications, in which the mere use of laser energy would not be economical or for concave parts within the functional surface that are not accessible to an inductor.

The process of the invention may be implemented in an apparatus that consists of several cooperating movement systems, on which the energy-forming units are flanged. This guarantees that the energy-forming units supplied by one or more energy sources can be moved on different path curves.

The energy sources may be lasers of various configurations. The solution is particularly flexible and cost-effective, if fiber-coupled high-powered diode lasers are used as energy sources and laser scanners as beam-forming units. For larger functional surfaces or larger necessary hardening depths, however, induction generators can be used and inductors as field-forming units. A particularly flexible and cost-effective device variant arises through the use of robots cooperating movement systems.

The solution according to the invention is not limited merely to boundary hardening tasks. Local annealing processes or solution annealing processes can also be conducted. Without violating the concept of the invention, for this purpose, only the austenitization temperature interval $\Delta T_a$ must be replaced by the temperature interval for short-term annealing $\Delta T_{an}$ or the boundary solution annealing of precipitation-hardenable steels $\Delta T_L$ for the process. The time difference $\Delta t_{ms}$ must also be replaced by $\Delta t_{180}$ for short-term annealing.

The invention is further explained in the practical examples set fourth herein.

DETAILED DESCRIPTION OF THE DRAWINGS

EXAMPLE 1

Figure 1:
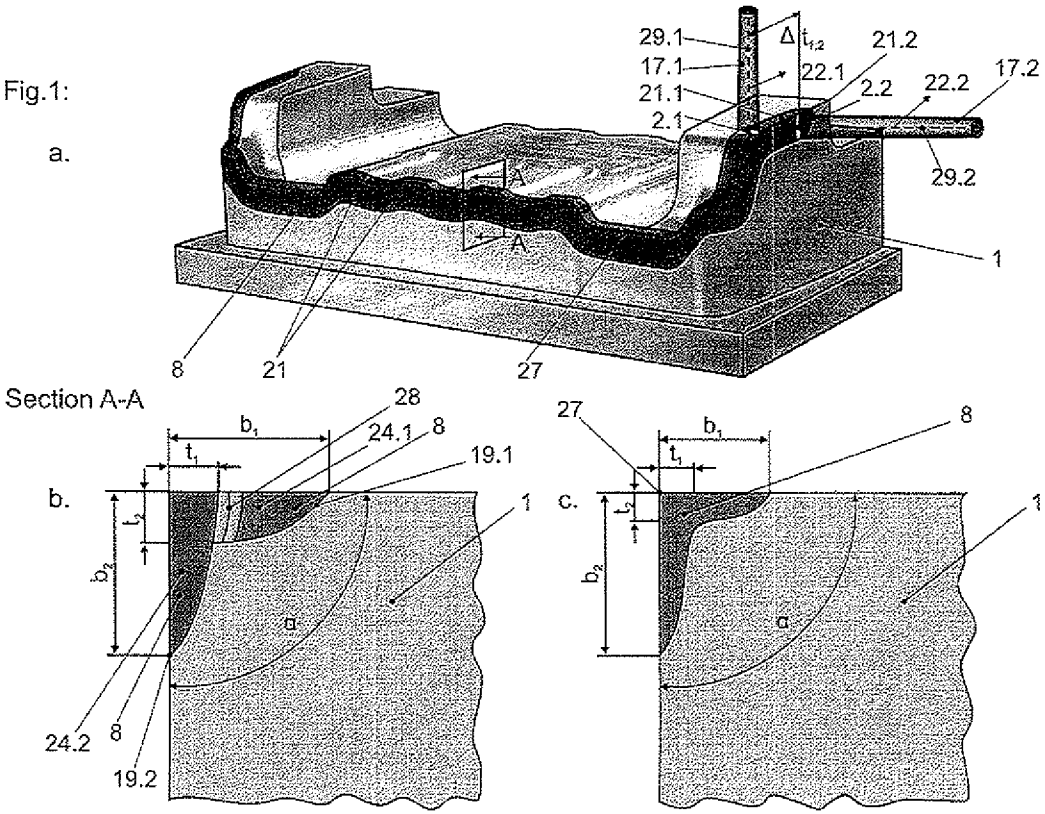
FIGS. 1*a-c*: shows a procedure according to the invention for boundary hardening of a three-dimensional cutting edge of a cutting tool

A cutting tool (see FIG. 1*a*) is to be boundary-hardened according to stress and with lower distortion than with conventional technologies. At the same time, a higher wear resistance is to be achieved. The cutting tool is made of steel X155CrMoV12.1 and in the normal tempered state has a hardness of 300 HV. The angle α between the two functional surfaces is about 85°. It was shown that both surfaces adjacent to the cutting edge must be hardened for hardening according to stress. In order to avoid brittle failure of the cutting edge, however, the edge must not be fully hardened.

Induction or laser hardening according to stress for these surfaces is only possible with difficulty. Induction hardening with a shaped inductor would not permit optimal hardening in the areas, in which the curvature of one or both individual hardening zones 24.1 and 24.2 is greater. With conventional laser beam hardening, the functional surfaces 24.1 and 24.2 would have to be hardened in succession. This would result in an annealing zone 28 by reannealing of the individual hardening zone 24.1 (see FIG. 1*a*), within which the boundary hardness drops from about 800 HV to about 420 HV. The result would be insufficient improvement of wear resistance.

Another variant of laser hardening would consist of positioning the component relative to the laser beam, so the laser beam impinges symmetrically on the two functional surfaces, moving the laser beam along abutting edge 27 and having it scan perpendicular to the advance direction. Although this variant permits hardening that is much more aligned with the stress, it is also only possible with difficulty to optimally harden all the areas of the functional surfaces. Zones, in which the abutting edge is strongly curved in one or more planes, pose particular problems. Here it is very difficult to guarantee the same austenitization temperature of the entire surface of the hardening zone without incipient melting.

For the solution of the task according to the invention, two laser beams 17.1 and 17.2 are used, which are emitted by two fiber-coupled high-power lasers (not shown). Both laser beams areguided through an optical fiber 13.1 and 13.2 into a beam-forming unit 9.1 and 9.2. By means of two laser beam scanners 14.1 and 14.2 that can be driven via the program of the movement machines they are scanned perpendicular to the advance direction. The oscillation mirrors of scanners 14.1 and 14.2 are driven with location-dependent oscillation functions. Power density distributions 16.1 and 16.2, adaptable in optimized fashion, are produced separately on this account for both individual hardening zones 24.1 and 24.2. Both movement systems 6.1 and 6.2 are programmed, so that the optical axes 29.1 and 29.2 of the two scanned laser beams 17.1 and 17.2 are perpendicular or almost perpendicular to the surfaces of the two energy effect zones 2.1 and 2.2, and each have a distance of ½ $b_1$ and ½ $b_2$ to the abutting edge 27 of the two functional surfaces 21.1 and 21.2. To achieve these different movement processes, the two movement systems 6.1 and 6.2 accomplish two fully different path curves. The power density distributions 16.1 and 16.2 are adjusted, so that the smaller heat removal in the vicinity of the abutting edge and at curvatures of the abutting edge 27 is compensated, so that a constant surface hardness is produced across the functional surfaces 21.1 and 21.2 being hardened. The required hardening depths $t_1$ and $t_2$ are determined by the energy effect time and adjusted by an appropriate length of the laser beam spot in the advance direction. The surface temperature is kept constant by pyrometer regulation of the power of the two lasers 12.1 and 12.2.

The required target advance speed of the two laser beams is determined from temperature field calculations, nomograms or a test on a material sample. At positions, where one of the two laser beams 17.1 and 17.2 ha covered a larger path, the focal distance is increased and the laser power raised. This ensures that the time difference $\Delta t_n$ between achievement of the maximum temperature of the temperature field 3.1 and the temperature field 3.2 is smaller than the time difference $\Delta t_{ms}$ between achievement of the maximum temperature and the beginning of the martensite start temperature MS. Because of this, annealing zones are reliably prevented.

As a result, a continuous optimally hardened hardening zone 8 according to stress is produced without annealing zones and with a constant hardness of 800 HV.

EXAMPLE 2

Figure 2:
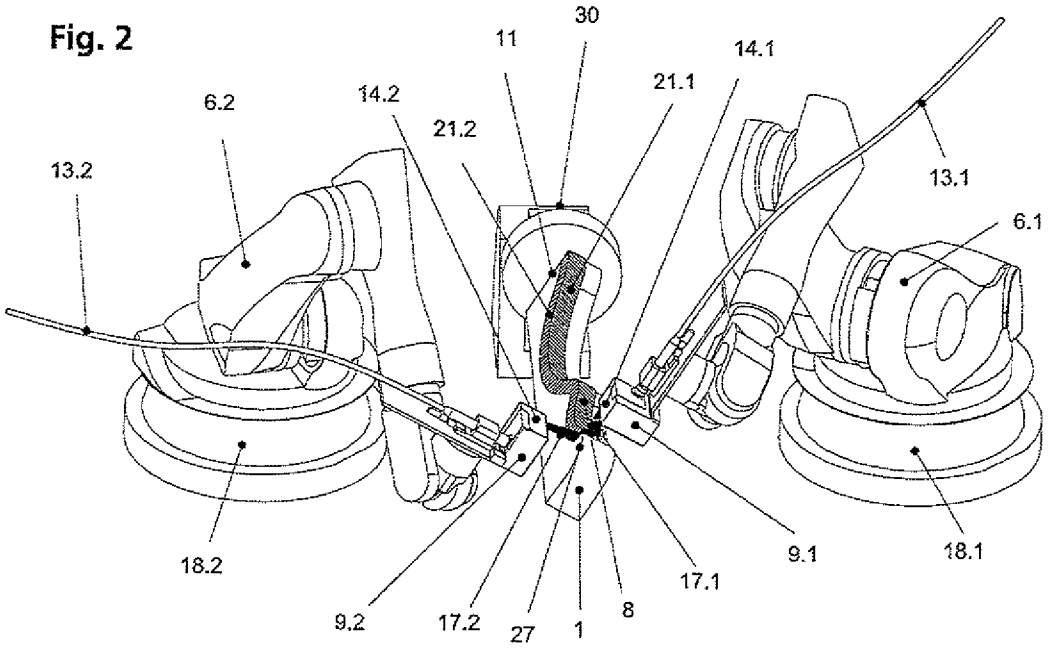
FIG. 2: shows a hardening unit with two cooperating robots

Referring to FIG. 2. the movement system 6.1 and the movement system 6.2 consist of robots 18.1 and 18.2, which are identical in design to each other. They cooperate with each other, i.e., both movement systems are coupled to each other, so that they travel adjusted to each other precisely in terms of geometry and time. The two tools move almost synchronously and, independently of the path curve of the individual robots, always reach the next end point at the same time. In addition, orientation relative to each other can be fixed, so that a change in tool position of one system in space is automatically compensated by the second system, which immensely simplifies the adjustment process.

A separate pivot axis 30, which is assigned to robot 18.1, is situated between them. On the arm of the two robots, two beam-forming units 9.1 and 9.2 are fastened. They have the two fiber optic guides 13.1 and 13.2, which can follow the movements of robots 18.1 and 18.2 via two flexible CFK rods, without falling below the critical bending radius. The two beam-forming units 9.1 and 9.2 each consist of a collimation and a focusing module. A laser beam scanner 14.1 and 14.2 is situated behind each focusing module. An obliquely positioned semitransparent mirror is situated between the laser scanner and the focusing module, which transmits the laser radiation. The heat radiation emitted by component 1 is reflected and fed to a pyrometer, which furnishes the input signal for the temperature control. The component 1 being hardened is fastened in a component clamping device, which is situated on the three-jaw power chuck of the pivot axis 30. For boundary hardening of functional surfaces 21.1 and 21.2, the component is favorably rotated, so that the abutting edge 27 points upward.

The robot 18.1 is programmed so that it travels the path for the functional surface 21.1 (a movement in the x and y-plane in the component coordinate system). Robot 18.2 covers the other path curve along the functional surface 21.2 (in the component coordinate system: x, y, z-axis, as well as the rotational movement in the C-axis). When programming of both robot paths with the target advance speed shows that at no point on the two path curves is their simultaneous offset $\Delta T_1$ greater than the cooling time $\Delta t_{ms}$ between the maximum temperature $T_{max\ 1,2}$ and the martensite start temperature MS, the movement program can be used. If, on the other hand, at any component position $\Delta t_{ms} > \Delta t_{max\ 1,2}$, the two advance speeds 22.1 and 22.2 are reprogrammed locally, until the condition $\Delta t_{ms} > \Delta t_{max\ 1,2}$ again applies. At the program steps, in which such intervention occurs, focusing of the laser beam and the laser power are changed for compensation.

EXAMPLE 3

Figure 3:
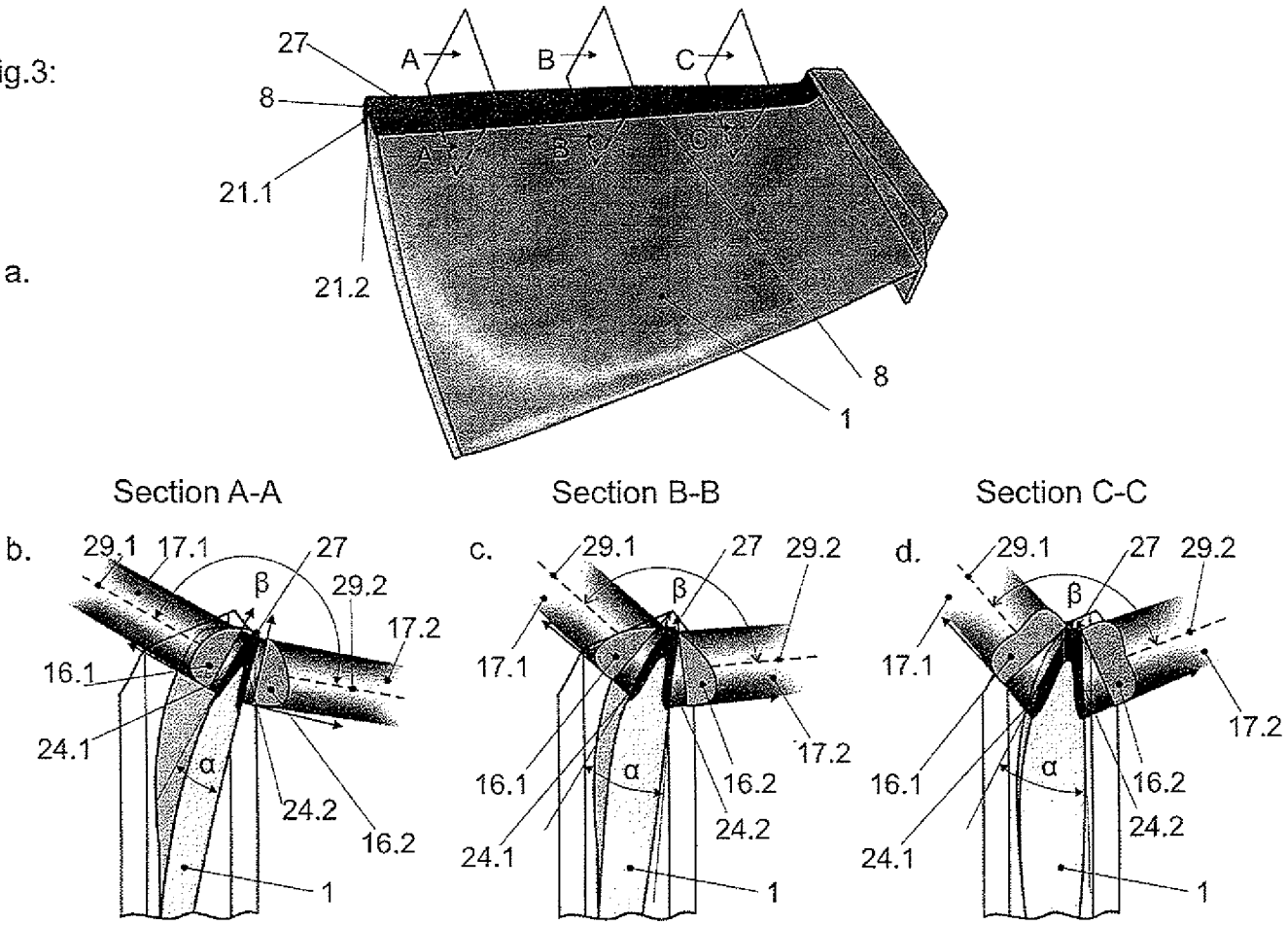
FIGS. 3*a-d*: shows an arrangement of the hardening zone and the power density distributions for hardening of the inlet edge of a compressor blade with two fiber-coupled high-powered diode lasers

A turbine blade (see FIG. 3*a*), which is subject to severe wear from erosive wear, protection of the blade inlet edge adapted to the stress is to be obtained. The particles impinge almost vertically on the blade inlet edge. It consists of steel X20Cr13 and is tempered to a hardness of 230 HV, in order to achieve a very tough texture. This highly annealed state, however, is not suitable to withstand the impingement erosion. It is known that laser hardening is very suited for significantly increasing the resistance relative to impingement erosion. Because of the high cyclic stress and the hazard of stress cracking, the blade tip, however, should not be overhardened. In order to make the hardening zone 8 consistent with the stress, it must have a dome shape adjusted to the local blade profile.

Both the twist of the blade, the blade thickness (see FIG. 3*b*, 3*c*, 3*d*), the geometry of the blade inlet edge and the reference contour of the dome-like hardening zone 8 to be hardened vary along the abutting edge 27 of the two functional surfaces 21.1 and 21.2 being hardened. In section A-A, the dome shape is supposed to be almost symmetric to a relatively large width of hardening in the vicinity of abutting edge 27. In section C-C, the relative target hardness depth is less and the hardening zone 8 is more adapted to the trend of the surface.

In order to achieve this formation and this trend of the hardening zone geometry, a number of parameters must be changed during laser hardening: scanning width of the two laser beams 17.1 and 17.2, power density distributions 16.1 and 16.2, slope of the two laser beams 17.1 and 17.2 relative to each other (angle β) and relative to the slope of the blade surface, effect time of the laser beam 17.1 and 17.2, laser power and advance speeds 22.1 and 22.2. Because of the asymmetry of the blade cross-section, the path curve of the movement system 16.2 also cannot be generated from a reflection of the path curve of movement system 16.1. For these reasons, it would be very disadvantageous to achieve this hardening task according to the prior art with one movement system.

To generate an optimal hardening zone geometry, two separately adjustable, but cooperating movement systems 6.1 and 6.2 are therefore used according to the invention. An advantageous embodiment is described in example 2, whose arrangement can also be used very well for hardening of the inlet edges of turbine blades.

Since the hardening task is very complex and numerous degrees of freedom exist for parameter adjustment, favorable power density distributions for a sufficient number of blade geometries are calculated via an FEM temperature field simulation. By a separate program, oscillation functions of the laser beam necessary for this purpose are determined from the desired power density distributions for selected ratios of oscillation amplitude and beam diameter.

The slope angle between the two laser beams 17.1 and 17.2 and the blade centerline and therefore angle β between the optical axes of the two laser beams is entered via a teach-in programming. The movement programs for the two robots 18.1 and 18.2 are then worked out from this. The necessary laser powers at the given parameter sets are determined via trial hardening on a material sample.

After entry of all parameters and calibration of the temperature control system, the hardening process is started. The result is a hardening zone 8 formed according to stress along the blade inlet edge in dome form, which permits optimal ratio of wear protection and oscillation strength in the turbine blade. The hardening zone 8 has a constant surface hardness over the entire track width within the functional surfaces 21.1 and 21.2. In addition, because of the optimally adjusted austenitization temperature and the large cooling rate as a result of abandonment of full hardening of the blade inlet edge, the hardening capacity of the steel is fully utilized.

EXAMPLE 4

Figure 4:
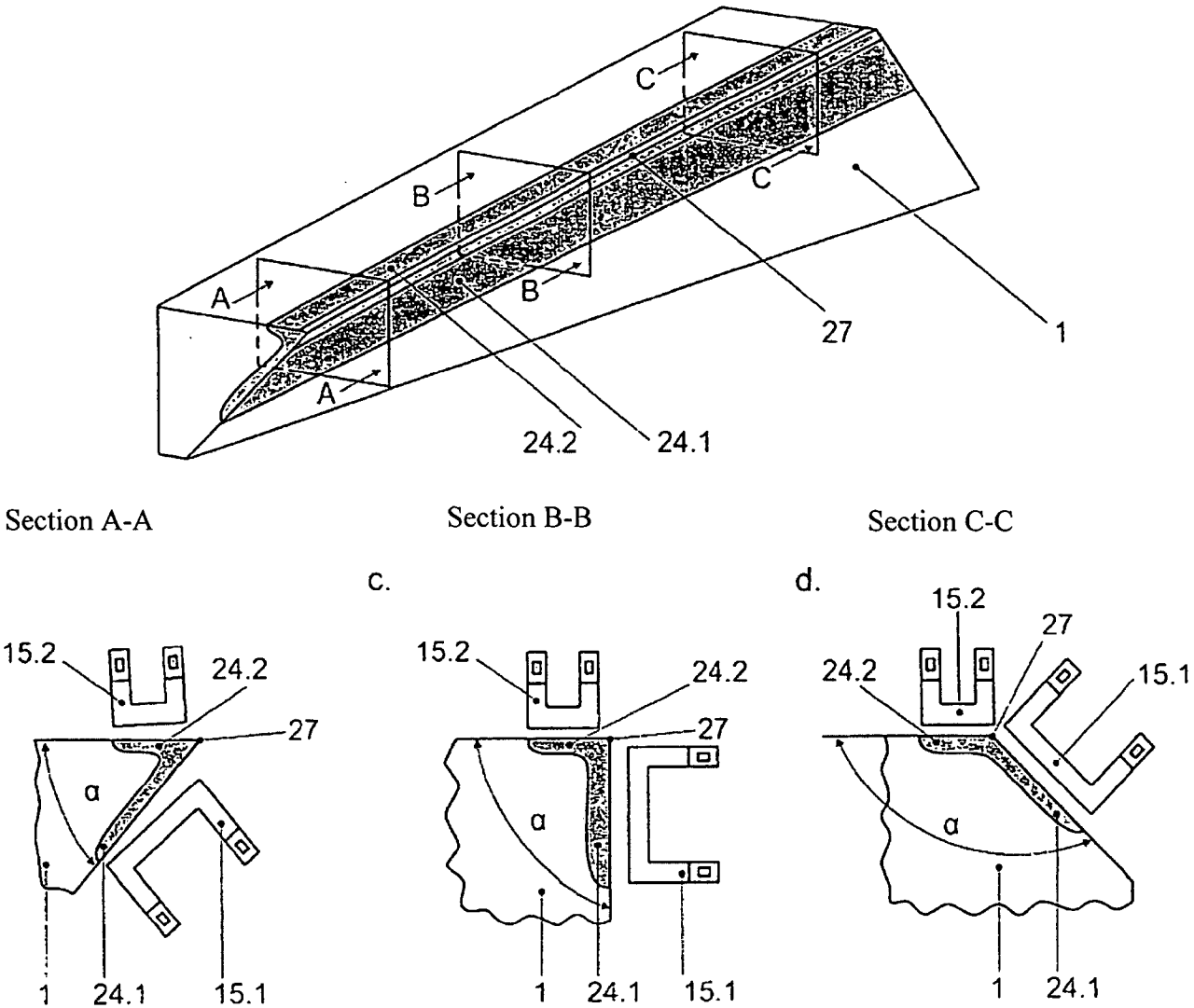
FIGS. 4*a-d*: shows an arrangement of the hardening zone and the inductors for hardening of a tool edge with alternating angle α between the two functional surfaces abutting each other

A deformation tool that has an abutting edge 27, whose angle α changes along the abutting edge (see FIG. 4*a*, as well as 4*b-d*), is to be inductively hardened. This is not possible with a shaped inductor and a single movement system.

The solution according to the invention proposes to connect and inductor 15.1 to the movement system 6.1 and a second inductor 15.2 to the movement system 6.2. The inductors 15.1 and 15.2 are designed differently according to the different hardening widths $b_1$ and $b_2$ and different hardening depths $t_1$ and $t_2$.

With approach to the abutting edge 27, the heat removal diminishes and overheating can be produced during heating directly on the abutting edge 27. This is countered by the fact that the bottoms of the inductor are not arranged parallel to the surface of the functional surface, but are sloped, so that they have a larger coupling distance in the direction of the abutting edge 27. In addition, a distance between the inductor end and abutting edge 27 to be adjusted by preliminary experiments is set. Both are the same for both inductors. Both the slope of the inductor bottoms relative to the surface of the functional surfaces and the distance between the inductor end and the abutting edges 27 are reduced with increasing angle α between the two functional surfaces along the hardening path (see section A-A, section B-B, section C-C in FIG. 4*b, c, d*). These two correction movements are superimposed on the movement programs generated from the CAD data of the component. With the installation configuration as explained in example 2, the necessary movement processes are generated with two separate movement systems. An important role is assigned to the time spacing between the two inductors. On the one hand, the inductors should not be too close to each other, so that the two inductive fields mutually affect each other; on the other hand, to avoid formation of annealing zones, the distance must not be too large. Consequently, at the position with the best heat removal (the largest angle α), the cooling rate is measured and the distance between the two inductors determined according to it. As an additional condition for the case of necessary outside quenching, it must be kept in mind that the water spray occurs before falling below the martensite start temperature.

The advantage of the arrangement according to the invention consist of the fact that with it

- a number of components of complex shape are accessible to the very inexpensive induction hardening without annealing zones,
- the flexibility of induction hardening units is increased,
- components with complicated shape can be hardened according to stress,
- variable hardening zone geometries, hardening zones, widths and depths can be produced by displacement of the relative positions between the inductors, but can be generated flexibly on a component by displacement of the relative positions between the inductors.

EXAMPLE 5

Figure 5:
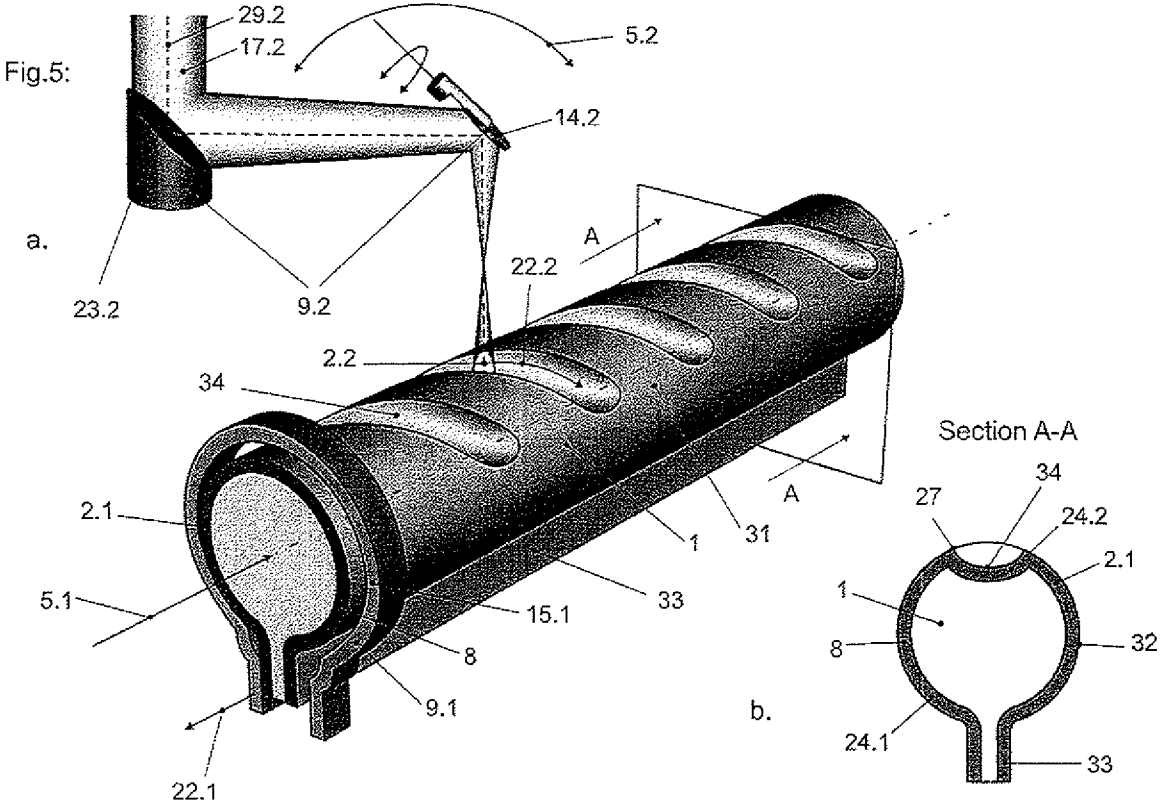
FIGS. 5*a-d*: shows the device for hardening of a spindle with incorporated guide tracks for the balls of a roller bearing.
Figure 5C:
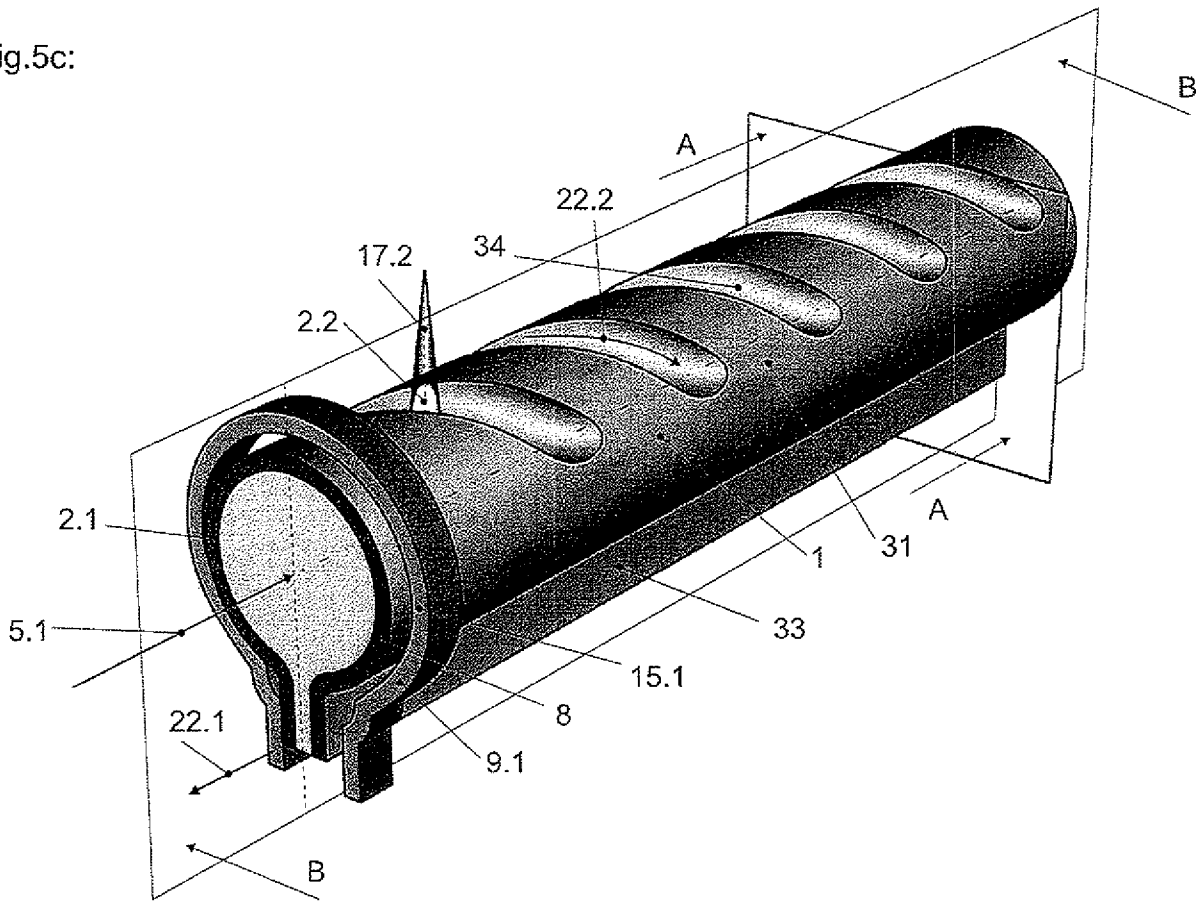
Figure 5D:
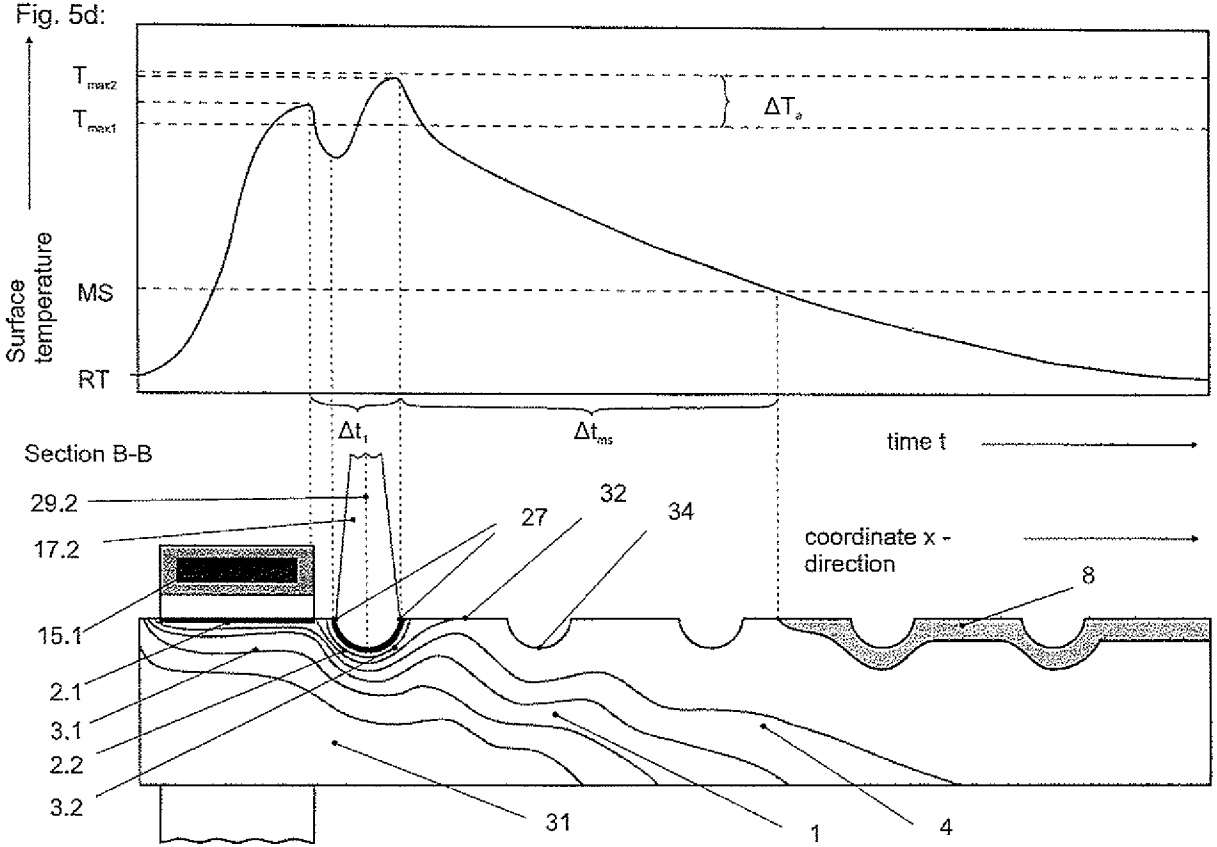

A guide spindle 31 with a circular cross-section, a longitudinal guide 33 and ball races 34 arranged obliquely to the cylindrical outer surface 32 is to be boundary-hardened completely, as shown in FIG. 5. It is made from ball bearing steel 100Cr6. The ball races 34 have a circular cross-section to increase the contact angle between the ball and the ball race. To reduce the vulnerability to cracks and to avoid soft annealing zones, the separately occurring hardening of cylindrical outer surface 32, longitudinal guide 33 and ball races 34 is not permitted. The task is solved by the fact that the entire component surface to be hardened is hardened with a uniform temperature field 4 in the advance. The uniform temperature field 4 arises through the coordinated overlapping (in time and space) according to the invention of two individual temperature fields 3.1 and 3.2, which, in this example, are generated, both by a laser as energy source and an inductor generator as energy source.

The inductor 15.1 then hardens the cylindrical outer surface 32 and the longitudinal guide 33, while the laser beam 17.1 hardens the ball races 34. For this purpose, the inductor 15.1 is designed as a shaped inductor, which includes the cylindrical outer surface 32 and the two side surfaces of longitudinal guide 33. The laser beam 17.1, on the other hand, is used to harden the ball races 34. For this purpose, a laser scanner 14.1 is again used, which scans the laser beam perpendicular to its direction of advance.

The movement system 6.1 consists of a simple hydraulic axis, which moves the very long guide spindle 31 with a constant advance speed through the inductor 15.1. The movement system 6.2 is a simple NC- or CNC-axis, which moves the beam-forming unit 9.2 on a circular path curve 5.2. Manual adjustment elements serve to adjust the relative position between laser beam 17.1 and inductor 15.1.

The movement speed 22.2 and the movement direction of the beam-forming unit 9.2 in movement system 6.2 are adjusted to the movement speed 22.1 of component 1 by the movement system 6.1 relative to inductor 15.1, so that their components are equally large in the advance direction of component 1. For effective performance of laser heating, laser hardening occurs after inductive heating. For energy reasons, the time distance $\Delta t_{1;2}$ between achieving maximum austenitization temperature $T_{max1}$ under the inductor 15.1 and achieving maximum austenitization temperature under laser beam 17.1 is chosen much shorter here than the time interval $\Delta t_{ms}$ before martensite formation occurs. The laser beam 17.1 is positioned directly behind inductor 15.1. The temperature is greater than 800° C. here. This has the advantage that only a fraction of the otherwise ordinary laser beam power is required, because of the energetic work division. A water spray is arranged behind the position of the laser beam effect.

Through coordinated movement of the two movement systems 6.1 and 6.2, an overlapping of the two individual temperature fields 3.1 and 3.2 of two different energy systems and to a uniform temperature field 4 that includes the entire functional surface 21 of component 1 and optimal hardening of the component, free of annealing zones, becomes possible.

LIST OF REFERENCE NUMBERS

1 Component being hardened
2 Energy effect zones 1 to n
3 Individual temperature fields 1 to n
4 Uniform temperature field
5 Path curves 1 to n
6 Movement systems 1 to n
8 Hardening zone
9 Energy-forming units 1 to n, beam-forming units 1 to n, field-forming units 1 to n
11 Component clamps 1 to n
13 Fiber optic guide 1 to n
14 Laser scanner 1 to n
15 Inductors 1 to n
16 Power density distribution 1 to n
17 Laser beams 1 to n
18 Robots 1 to n
19 Hardening width 1 to n
20 Hardening depth 1 to n
21 Functional surfaces 1 to n being hardened
22 Advance speeds 1 to n
23 Focusing optics 1 to n
24 Individual hardening zones 1 to n
27 Abutting edge between functional surfaces
28 Annealing zone
29 Optical axes of laser beams 1 to n
30 Pivot axis
31 Guide spindle
32 Cylindrical outer surface
33 Longitudinal guide
34 Ball race
$\Delta T_a$ Austenitization temperature interval
MS Martensite start temperature
$T_{max\,n}$ Maximum temperature of individual temperature field 3.*n*
$\Delta t_n$ Time distance between maximum temperatures $T_{max\,n}$ and temperature fields 3.*n* and 3.*n*+1
$\Delta t_{ms}$ Time distance between reaching the maximum temperature $T_{max\,n}$ and the beginning of the martensite start temperature MS
$\Delta t_{180}$ Time distance between reaching maximum temperature $T_{max\,n}$ and temperature of the first annealing stage in the hardenable steels 180° C.
$\alpha$ Angle between the surfaces of two abutting functional surfaces
$\Delta T_{an}$ Annealing temperature interval
$\Delta T_L$ Solution annealing temperature interval
$b_n$ Hardening width of the individual hardening zone n
$t_n$ Hardening depth of the individual hardening zone n
b Hardening width of the entire hardening zone
t Hardening depth of the entire hardening zone
$\beta$ Angle between the optical axis of two laser beams
A, B Positions on the functional surfaces being hardened

The invention claimed is:

1. Method for boundary hardening of components having complicated shapes, wherein the components have two adjacent functional surfaces defining an abutting edge therebetween that extends in a three-dimensional path and/or the angle between the adjacent functional surfaces changes along the abutting edge path, comprising creating plural energy effect zones on different path curves separated in space and time through the use of cooperating movement systems that are moved and guided with respect to the functional surfaces of the components, wherein a uniform temperature field fully enclosing the functional surfaces of the component is formed by overlapping individual temperature fields along the abutting edge of the functional surfaces within which at each surface element of the later hardening zone of the component, a chosen austenitization temperature interval $\Delta T_a$ is reached at least once and a time interval $\Delta t$ between reaching the austenitization temperatures of the individual temperature fields is smaller than a time $\Delta t_{ms}$ required to drop from the austenitization temperature to the martensite start temperature MS during its cooling phase.

2. Method according to claim 1, comprising adjusting power density distribution of individual energy effect zones separately to local heat removal conditions and desired hardening widths and hardening depths.

3. Method according to claim 1, wherein laser radiation is used to generate individual temperature fields.

4. Method according to claim 1, comprising adjusting power density distribution to local heat removal conditions and desired hardening width and hardening depth by appropriate oscillations of partially defocused laser beams and oscillation functions for the laser beam oscillations are driven or generated independent of location by the controls of the movement systems.

5. Method according to claim 1, comprising using inductive energy to generate the individual temperature fields.

6. Method according to claim 1, comprising adjusting power density distribution to local heat removal conditions and desired hardening widths and hardening depths by adjusting the overlapping between individual inductors, and implementing it through programs of the movement system.

7. Method according to Claim characterized by the fact that the uniform temperature field occurs through simultaneous effect of both power density distributions generated by laser radiation and inductively.

* * * * *